US005400104A

United States Patent [19]

Earle et al.

[11] Patent Number: 5,400,104

[45] Date of Patent: Mar. 21, 1995

[54] PHOTOGRAPHIC PROCESSING APPARATUS

[75] Inventors: Anthony Earle, Harrow Weald; Edward C. T. S. Glover, London, both of England

[73] Assignee: Eastman Kodak Company, Rochester, N.Y.

[21] Appl. No.: 226,729

[22] Filed: Apr. 12, 1994

[30] Foreign Application Priority Data

Apr. 13, 1993 [GB] United Kingdom ..... 9307505

[51] Int. Cl.[6] ..... G03D 3/08

[52] U.S. Cl. ..... 354/320; 354/323

[58] Field of Search ..... 354/319–324; 355/27, 28, 100

[56] References Cited

U.S. PATENT DOCUMENTS 3,331,276 7/1967 Oliver ..... 355/100

4,300,828 11/1981 Kaufmann ..... 354/322

4,575,209 3/1986 Zwettler ..... 354/322

*Primary Examiner*—D. Rutledge

*Attorney, Agent, or Firm*—Frank Pincelli

[57] ABSTRACT

In known processing apparatus of the dip-and-dunk type, processing tanks are arranged in a predetermined order, and the material to be processed follows a predetermined sequence as a support on which the material is mounted is moved from the start to the end of the apparatus. Described herein is an improved photographic processing apparatus (100) comprising six processing tanks (1, 2, 3, 4, 5, 6) which are surrounded by a frame (7, 8, 9) carrying a carriage (14). The carriage (14) is moved along cross-member (9) which itself can be raised or lowered relative to upright elements (7, 8). Motors (10, 11) are operated by a controller (15) to control movement of the carriage (14) and the cross-member (9) using belts (12, 13) and hence the movement of material (16) through the apparatus.

1 Claim, 1 Drawing Sheet

PHOTOGRAPHIC PROCESSING APPARATUS

FIELD OF THE INVENTION

The present invention relates to photographic processing apparatus and is more particularly concerned with such apparatus having programmable control.

BACKGROUND OF THE INVENTION

Processing apparatus of the dip-and-dunk type are well known. They commonly consist of a series of deep processing tanks which are arranged in a predetermined order which is related to the photographic processing stages, i.e. developer, bleach, fix, wash, wash and wash.

Photographic material to be processed, either in the form of film or paper, is attached to a support so that it hangs vertically over the deep processing tanks. The support and any attached photographic material is mounted so that it can be progressed along the tank line starting at the developer stage and finishing with the washing stages. Some apparatus incorporate a dryer stage after the wet stages.

In apparatus of the type described above, the material being processed has to follow a predetermined sequence as the support is moved from the start to the end of the machine. This does not allow the material to pass back to a previously visited processing stage.

SUMMARY OF THE INVENTION

It is therefore an object of the present invention to provide an improved processing machine in which the material being processed can be re-directed back to a previously visited processing stage.

In accordance with the present invention, there is provided photographic processing apparatus comprising a plurality of processing stages, and transporting means for transporting material to be processed through the apparatus and into each of the processing stages, characterized in that programmable control means are provided for controlling the transporting means so that the material to be processed can be directed to any processing stage and in any particular order in a forward or backward direction.

ADVANTAGEOUS EFFECT OF THE INVENTION

By this arrangement, it is possible for the material being processed to be processed more than once in a particular processing stage.

Furthermore, the material being processed need not follow the conventional series of processing stages as discussed above.

BRIEF DESCRIPTION OF THE DRAWINGS

For a better understanding of the present invention, reference will now be made, by way of example only, to the accompanying drawing, the single FIGURE of which illustrates processing apparatus constructed in accordance with the present invention.

DETAILED DESCRIPTION OF THE INVENTION

Figure 1:
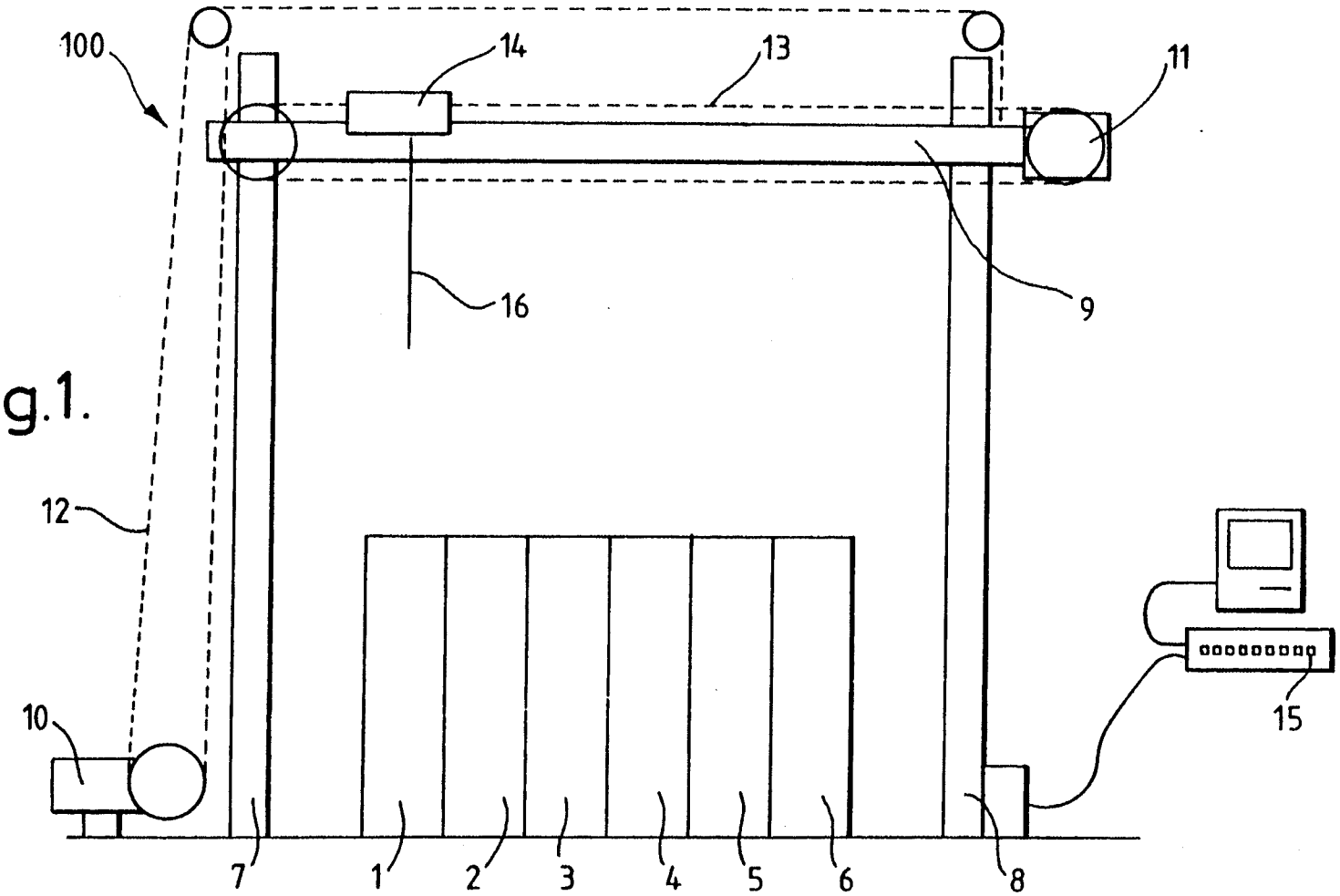

FIG. 1 illustrates a photographic processing machine 100. The machine comprises six processing tanks 1, 2, 3, 4, 5, 6 arranged side-by-side and contain processing solutions in any convenient order. Positioned around the tanks 1, 2, 3, 4, 5, 6 is a frame consisting of a pair of upright elements 7, 8 which support a cross-member 9. Cross-member 9 can be raised or lowered relative to the upright elements 7, 8 by means of a motor 10 and drive chain or belt 12.

A carriage 14 is mounted on the cross-member 9 and is moved along the cross-member 9 by a motor 11 and drive chain or belt 13. Material 16 to be processed is attached to the carriage 14 for transportation from one tank to another as the carriage 14 is moved along the cross-member 9 and as the cross-member 9 is raised and lowered with respect to the tanks 1, 2, 3, 4, 5, 6.

A controller 15 is connected to the machine 100 to control the raising and lowering of the cross-member 9 by way of motor 10 and also the movement of the carriage 14 backwards and forwards along the cross-member 9 by way of motor 11. Motors 10, 11 have a positional feed back system which enables the controller 15 to know where the carriage 14 and the cross-member 9 are at all times.

Material 16 is processed using a suitable process which is chosen from an initial selection held in the controller 15 or using a process which has been written for that particular material.

As will be readily understood, the material 16 is not continuously processed, but is dipped into one tank and then removed and passed on to another tank into which it is dipped and so on. The order of the tanks into which the material being processed is dipped and amount of time for which the material is immersed in a particular solution are both controlled by the controller 15.

In the FIGURE, a single piece of material 16 is shown being processed. However, it is possible to process more than one material at a given time. This can either be done using a single carriage, or more than one carriage may be employed.

Parts List

1,2,3,4,5,6—processing tanks
7,8—upright elements
9—cross-member
10,11—motor
12,13—drive chain/belt
14—carriage
15—controller
16—material
100—photographic processing machine

We claim:

1. Photographic processing apparatus comprising a plurality of processing stages, and transporting means for transporting material to be processed through the apparatus and into each of the processing stages, characterized in that programmable control means are provided for controlling the transporting means so that the material to be processed can be directed to any processing stage and in any particular order in a forward or backward direction.

* * * * *